United States Patent [19]

Lebet

[11] 4,259,130

[45] Mar. 31, 1981

[54] PRODUCTION OF ROD-SHAPE ELEMENTS

[76] Inventor: Jean-Pierre Lebet, Rue Colondalles 38, Montreux, Switzerland, CH-1820

[21] Appl. No.: 968,833

[22] Filed: Dec. 12, 1978

[30] Foreign Application Priority Data

Dec. 15, 1977 [CH] Switzerland ..... 15432/77

[51] Int. Cl.[3] ..... B29H 9/02; B32B 5/00; A24C 1/32; B31C 13/00

[52] U.S. Cl. ..... 156/180; 156/276; 156/279; 156/441; 131/88; 131/91; 131/93; 493/45; 493/50

[58] Field of Search ..... 156/166, 180, 276, 279, 156/441; 93/1 C, 77 FT; 131/10 R, 88, 89, 90, 91, 92, 93, 94, 95

[56] References Cited

U.S. PATENT DOCUMENTS 3,837,264 9/1974 Sexstone ..... 93/77 FT 3,957,563 5/1976 Sexstone ..... 93/77 FT 4,164,438 8/1979 Lebet ..... 156/180

*Primary Examiner*—John T. Goolkasian

*Assistant Examiner*—L. Falasco

*Attorney, Agent, or Firm*—Eric P. Schellin

[57] ABSTRACT

A continuous strand consisting of loose filamentary and/or fibrous material is brought into engagement with a conveying and forming belt in at least approximately tension-free condition by means of at least one continuously moving conveying element which extends into the strand-gripping zone of the conveying and forming belt and which engages the interior of the strand. Next the strand is enveloped and brought to the desired cross-section by said belt. After achieving the desired cross-sectional form of the strand, the strand material is interfixed. The thus formed form-stable rod is then divided into rod-shaped portions by a cutting-device.

20 Claims, 24 Drawing Figures

20
42
40
14
1

41
20
1

20
40
17
1

35
20
32
17
1

30
29
17
20
14

17
26
14
20
1
25

20
24
14
23
1
b
14
22
1
20
21

47
48
1'

16
17
1'
19
14

8
12
1
13

8
1
12

11
8
12
1

9
8

1

PRODUCTION OF ROD-SHAPE ELEMENTS

BACKGROUND OF THE INVENTION

The present invention concerns a process for the continuous manufacture of form-stable rod-shaped elements from interlocked and interbonded filamentary and/or fibrous material; a system for the performance of such process; cigarette filter units manufactured by such process; and applications of the process.

There is a known process for the manufacture of form-stable rod-shaped elements of interlocked and interbonded filamentary and/or fibrous material wherein a continuous strand of fibrous material is impregnated with a plasticizer serving as a binder and, in conjunction with compaction of the strand material, is drawn through a steam-heated nozzle. In the latter operation, the non-enveloped outside of the strand slides directly along the inside of the nozzle. However, the pull necessary a draw the strand through the nozzle involves an undesirable reduction of the curl of the filaments or fibres and, accordingly, of the stability of the so manufactured rod against radial deformation. In another known process, the non-enveloped strand passes through a funnel, in which it is sharply compressed, and thence passes to a conveyor on which it is enveloped and pressed to the form desired. As the strand, before passing to the conveyor, is drawn through the funnel, this process also involves an undesirable stretching of the strand.

SUMMARY OF THE INVENTION

The object of the present invention is to provide a process which does not involve the aforesaid disadvantages of the known processes.

The invention concerns a process for the manufacture of form-stable rod-shaped elements from interlocked and interbonded filamentary and/or fibrous material, wherein a continuous strand consisting of loose filamentary and/or fibrous material is passed to an endless continuously revolving conveying and forming belt, and is enveloped and brought into the desired cross-section by the said belt, and wherein, after achieving the desired strand cross-section, the strand material is interfixed, and the form-stable rod thus formed is divided into rod-shaped portions by a cutting device; which is characterized in that the strand consisting of loose filamentary and/or fibrous material is brought into engagement with the conveying and forming belt by means of at least one continuously revolving conveying element which extends into the strand-gripping zone of the conveying and forming belt and which engages the interior of the strand.

In order to reduce, over an extended distance, the effect of tensile forces on the strand to be formed, it is advantageous to use for conveying element an endless continuously revolving conveyor belt provided on its outside with engaging means which can be brought into engagement with the inside of the strand.

It is further advantageous, for the manufacture of chambered rod-shaped components, to use a conveying element whereof the engaging means are designed as chamber-forming elements, and in this it is also advantageous to use chamber-forming elements having a form corresponding to the chamber form desired in the final product.

To achieve a chamber and rod exterior form as accurate as possible, it is advantageous to cause the strand consisting of loose filamentary and/or fibrous material to be arranged at least approximately evenly distributed around the chamber-forming elements, in a manner that in the chamber-forming zone of the strand, viewed across the entire strand cross-section, the material density is everywhere at least approximately equal; next, to cause the strand together with the inserted chamber-forming elements to engage the conveying and forming belt; to cause the latter to envelop the strand and bring it to the final strand cross-section; and then to interfix the strand material and remove the chamber-forming elements from the now form-stable rod. In this, it is further advantageous to cause the strand consisting of loose filamentary and/or fibrous material to be fed in loose condition and at an acute angle to the conveying belt which is provided with the chamber-forming elements and which is arranged at least approximately in a straight line and which, in the forming zone, extends at least approximately parallel to the corresponding section of the conveying and forming belt; and to bring the strand into engagement with the first-mentioned conveying belt.

It is advantageous to use a strand whereof the filaments and/or fibres are inter-adhesive by means of a binder which is contained in the strand and is activatable by heat. In this, it is advantageous to use a strand whereof the filaments and/or fibres consist of acetate cellulose and are wetted on their surface with a plasticizer. It is further advantageous to cause the strand, prior to its envelopment and compression by the conveying and forming belt, to be permeated with a gaseous medium, preferably steam of a temperature between 110° and 130° C., and, after achieving the strand cross-sectional form, to pass a cooling gas, preferably air, through the strand material for the purpose of fixing it.

For the manufacture of chambered rod-shaped components whereof the chambers are filled with quasi-fluid and/or fibrous material, it is advantageous to pass the form-fixed rod, prior to its division into portions, through a filling station, to fill the chambers with the quasi-fluid and/or fibrous material and subsequently to affix lengthwise of the continuously advancing rod a sealing strip covering at least the chamber fill apertures, and then to divide the rod into the portions desired. In this, it is advantageous, prior to filling the chambers with quasi-fluid and/or fibrous material, to apply lengthwise of the rod a strip masking the chamber fill apertures.

For the manufacture of filters having two or more chambers, it is advantageous to use at least two conveying elements arranged in mutually inclined planes which, in the chamber-forming zone, extend through the longitudinal axis of the strand, so that the chamber-forming elements of the said conveying elements succeed one another alternately in the chamber-forming zone, and thereby to form chambers whereof the chamber fill apertures also are arranged alternately on different sides of a plane extending through the longitudinal axis of the strand. This arrangement is advantageous for the purpose of filling different materials into alternate chambers, in particular by filling a first material through the chamber fill apertures which are located on a first strand jacket line and which are formed by the first conveying element provided with chamber-forming elements, and by filling a second material, different from the first, through the chamber fill apertures which are located on a second strand jacket line and which are formed by the second conveying element provided with chamber-forming elements. In this, it is advantageous, for the purpose of preventing any twist of the formed strand about its longitudinal axis after formation of the chambers, to cause guide means which are arranged on a revolving part located in a plane extending through the longitudinal axis of the strand to engage the chamber fill apertures.

It is a further object of the present invention to provice a device for the performance of the process according the invention, comprising feed means for for feeding the continuous strand consisting of loose filamentary and/or fibrous material; an endless continuously revolving conveying and forming belt for enveloping the strand and forming the latter to the desired strand cross-section; means for interfixing the strand material in the desired cross-sectional form of the strand; and cutting means for dividing the thus formed form-stable rod into rod-shaped portions, and which is characterized in that it comprises a conveying element which presents engaging means and which extends into the strand-gripping zone of the conveying and forming belt and which is capable of being brought into engagement with the interior of the strand and which is intended to deliver the strand to the conveying and forming belt.

For the manufacture of chambered filters, it is advantageous to have the engaging means designed as chamber-forming elements. In this, it is advantageous to cause the conveyor belt provided on the outside with the chamber-forming elements to extend parallel to the conveying and forming belt at least in the strand-forming zone thereof, in a manner that in the said zone the chamber-forming elements extend into the said belt, and, further, to provide for strand feed means for the purpose of causing the strand, prior to the interaction of the conveying belt having chamber-forming elements with the conveying and forming belt, to engage the conveying belt in loose condition and at an acute angle and to be laid around the chamber-forming elements.

Where a strand consisting of acetate-cellulose fibres and wetted with plasticizer is used, for instance, it is advantageous to provide an arrangement wherein, viewed in the conveying direction of the strand and immediately before the point of the first envelopment of the strand by the conveying and forming belt, there are introductory means surrounding the strand not yet compressed to the final diameter, for the purpose of passing a hot gaseous medium, preferably steam of a temperature between 110° and 130° C., through the strand.

In this, it is advantageous to provide an arrangement wherein, viewed in the conveying direction of the strand and before the end of the enveloping and forming zone formed by the conveying and forming belt, there are introductory means surrounding the strand shaped to its final form, for the purpose of passing a cooling gas, preferably air, through the strand in order to fix the strand material in the formed state.

For the manufacture of rods provided with filled chambers, it is advantageous to provide an arrangement wherein, after the chamber-forming zone, there is a filling station which is slidably connectable with the surface of the travelling rod, for the purpose of filling quasi-fluid and/or fibrous material into the chambers formed in the rod; and wherein there are means for applying a sealing strip which covers and seals at least the chamber fill apertures of the filled chambers in a position lengthwise of the continuously advancing rod.

For the manufacture of cigarette filters having at least two mutually separate chambers it is advantageous to provide an arrangement wherein there are at least two conveying elements arranged in mutually inclined planes which, in the chamber-forming zone, extend through the longitudinal axis of the strand, so that the chamber-forming elements of the said conveying elements succeed one another alternately in the chamber-forming zone, for the purpose of forming chambers whereof the chamber fill apertures also are arranged alternately on different sides of a plane extending through the longitudinal axis of the strand. In this, it is advantageous to provide an arrangement wherein there are at least two filling stations each having a sliding means provided with an outlet aperture, the two sliding means being displaced with respect to each other in such a manner that during the filling operation the outlet aperture of the one sliding means moves in a laterally sealed manner over the chamber fill apertures which are located on a first jacket line of the strand and which are formed by the first conveying element provided with chamber-forming elements; and that the outlet aperture of the other sliding means moves in a laterally sealed manner over the chamber fill apertures which are located on a second jacket line of the strand and which are formed by the second conveying element provided with chamber-forming elements.

It is yet a further object of the present invention to provide a cigarette filter unit manufactured by the process claimed hereunder, preferably a cigarette filter unit consisting of several cigarette filters whereof each is provided with at least one chamber.

It is finally a further object of the present invention to provide for an application of the process claimed hereunder for the manufacture of cigarette filters or of fibrous rods intended for fibre styli.

BRIEF DESCRIPTION OF THE DRAWINGS

The present invention is now to be illustrated by way of example with reference to the drawing, in which.

DETAILED DESCRIPTION OF PREFERRED EMBODIMENTS

Figures 1, 2, 3:
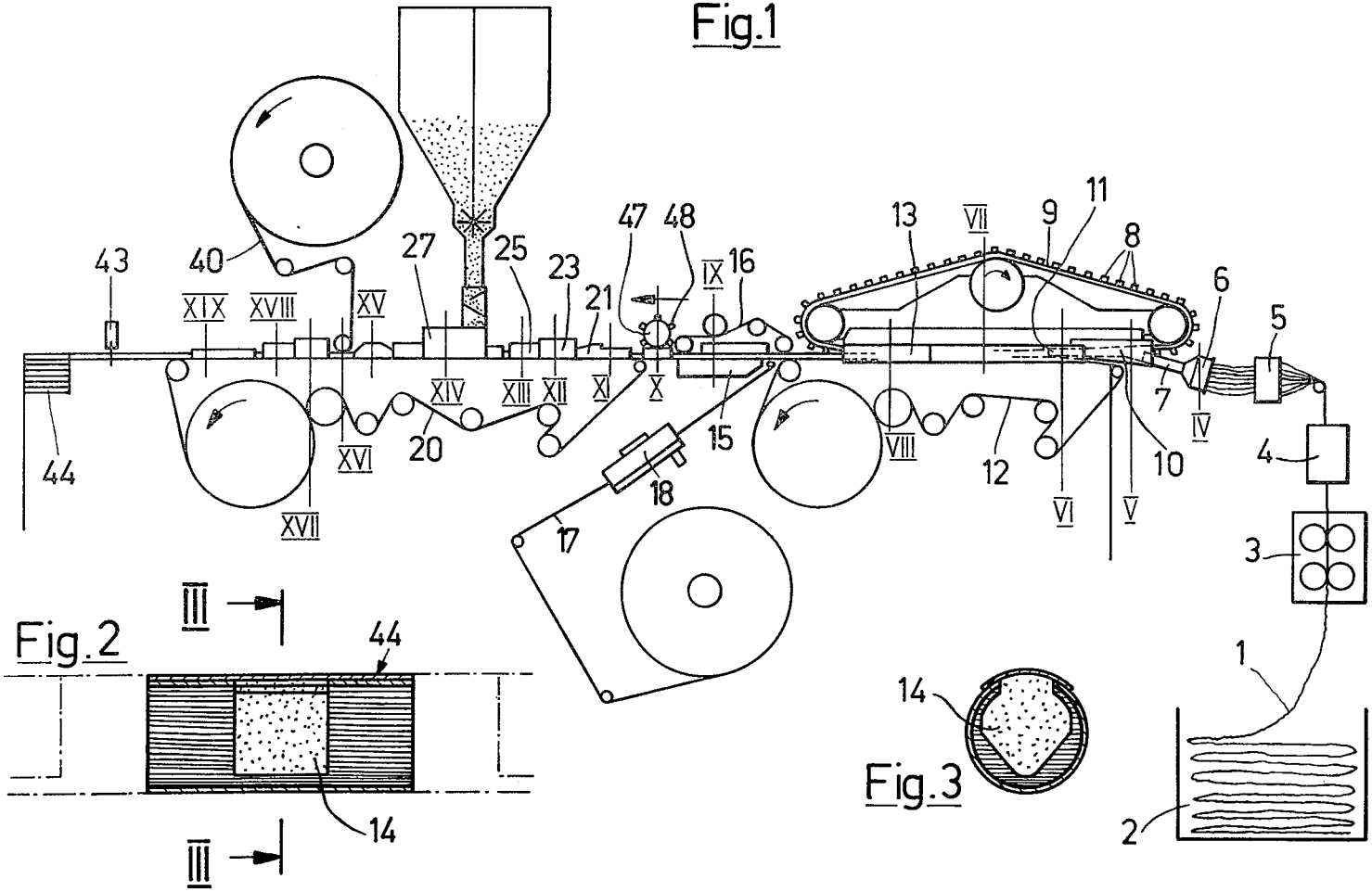
FIG. 1 shows a schematic side view of an embodiment of a system according to the present invention for the manufacture of cigarette filters provided with chambers.
FIG. 2 shows a longitudinal section through a cigarette filter manufactured with the system shown in FIG. 1.
FIG. 3 shows a section along line III—III indicated in FIG. 2.

As may be seen from FIG. 1, in the arrangement shown an acetate-cellulose strand 1 is drawn from a bale 2, forwarded to a curling and stretching unit 3, and wetted with plasticizer in a chamber 4.

The flat strand 1 thus treated is then divided by a unit 5 and forwarded to an air nozzle 6, such as is known from the U.S. Pat. No. 3,050,430, for the purpose of uniformly gathering the strand fibres into a loose strand of circular cross-section.

Next, by means of a guide tube 7 connected to the nozzle 6, the strand 1 passes, in loose state and continuously, to a guide element 10 surrounding the conveying belt 9 provided with chamber-forming elements 8, and is gradually brought into engagement with the revolving chamber-forming elements 8.

The conveying belt 9 may consist of reinforced toothed belts, for instance, to which the chamber-forming elements 8 are fixed.

Figures 4, 5, 6, 7, 8, 9, 10, 11, 12, 13, 14, 15, 16, 17, 18, 19:
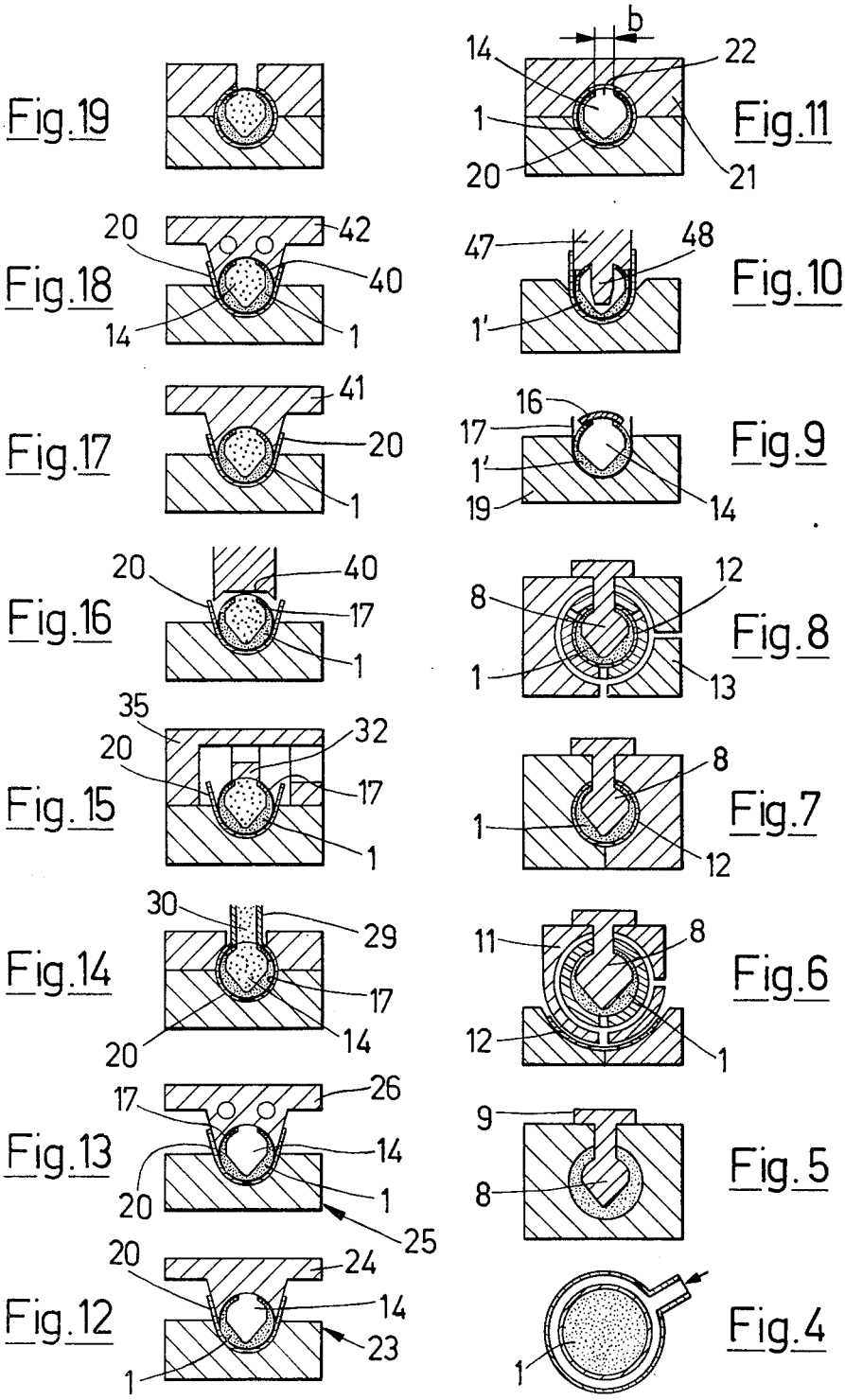
FIGS. 4 to 19 show various sections along lines IV to XIX indicated in FIG. 1.

By means of the guide element 10, the strand fibres are uniformly laid around the chamber-forming elements 8 and, by means of the latter, relieved with respect to tensile forces in the longitudinal direction of the strand, are gradually more strongly pressed around the chamber-forming elements 8, reduced to a smaller strand diameter, and then the strand 1, thus formed around the chamber-forming elements 8, passes to a heating unit 11 where hot steam of a temperature of about 120° C. is passed through the strand 1 (see also FIG. 6).

Immediately after the heating unit 11, the strand 1 thus heated is at once brought to engage the conveying and forming belt 12, is enveloped by the latter, and gradually further compressed to the final diameter desired.

Arranged at the end of the forming assembly is a cooling unit 13 (see also FIG. 8) which passes cold air through the completely formed strand 1 for the purpose of fixing the individual strand fibres in their position.

After the fixation of the rod form, the chamber-forming elements 8 move out of the chambers 14 formed by them. Because the chamber-forming elements 8, even at strand advance rates of 80 meters/min and more, are embedded in the strand material for a relatively long time during fixation of the position of such material, and because the chamber-forming elements are not removed from the thus formed form-stable rod until fibre fixation is complete, the process produces a rod 1' having chambers 14 which has a high dimensional stability and form accuracy.

The rod 1' subsequently passes to an enveloping station 15 where any fibres caused to stand up by the removal of the chamber-forming elements 8 from the chambers 14 formed by them are pressed down on to the rod surface by means of an endless belt 16 resting on the topside of the rod 1', in order to ensure a neat and even exterior of the rod 1'. At the same time, the arrangement feeds from below an enveloping strip 17 whereof the side coming into contact with the rod surface was provided with a thermoplastic adhesive at the adhesive application station 18. The said adhesive is heated in the enveloping station 15 by means of a heating unit 19 capable of being pressed against the rod 1' from below, and thus the enveloping strip 17 is bonded to the underside of the rod 1'.

Of course, it is possible to omit this enveloping strip 17, because the rod 1' is by itself sufficiently form-stable.

To prevent the rod from twisting about its longitudinal axis, the arrangement includes, after the enveloping station 15, as may be seen from FIG. 7 also, and above the rod 1', a rotatable guide wheel 47 provided with guide dogs 48 which, guiding laterally, engage the fill apertures 22 of the chambers 14.

Next, the rod 1', formed and enveloped as described, is passed by a further conveying belt 20 to a forming unit 21 (see also FIG. 11) in which the enveloping strip 17 is laid around the rod 1' to such an extent as to leave free a slot width corresponding to the width (b) of the chamber fill aperture 22. Then, in a heating station 23, the adhesive of the portion of the enveloping strip 17 which is not yet bonded to the rod 1' is softened by means of a heating element 24 resting on the entire upper half of the rod; subsequently, in the cooling station 25, the adhesive is caused to set by means of a cooling element 25, cooled with water for instance, and thus the enveloping strip 17 is completely bonded to the exterior of the rod 1'.

Figure 20:
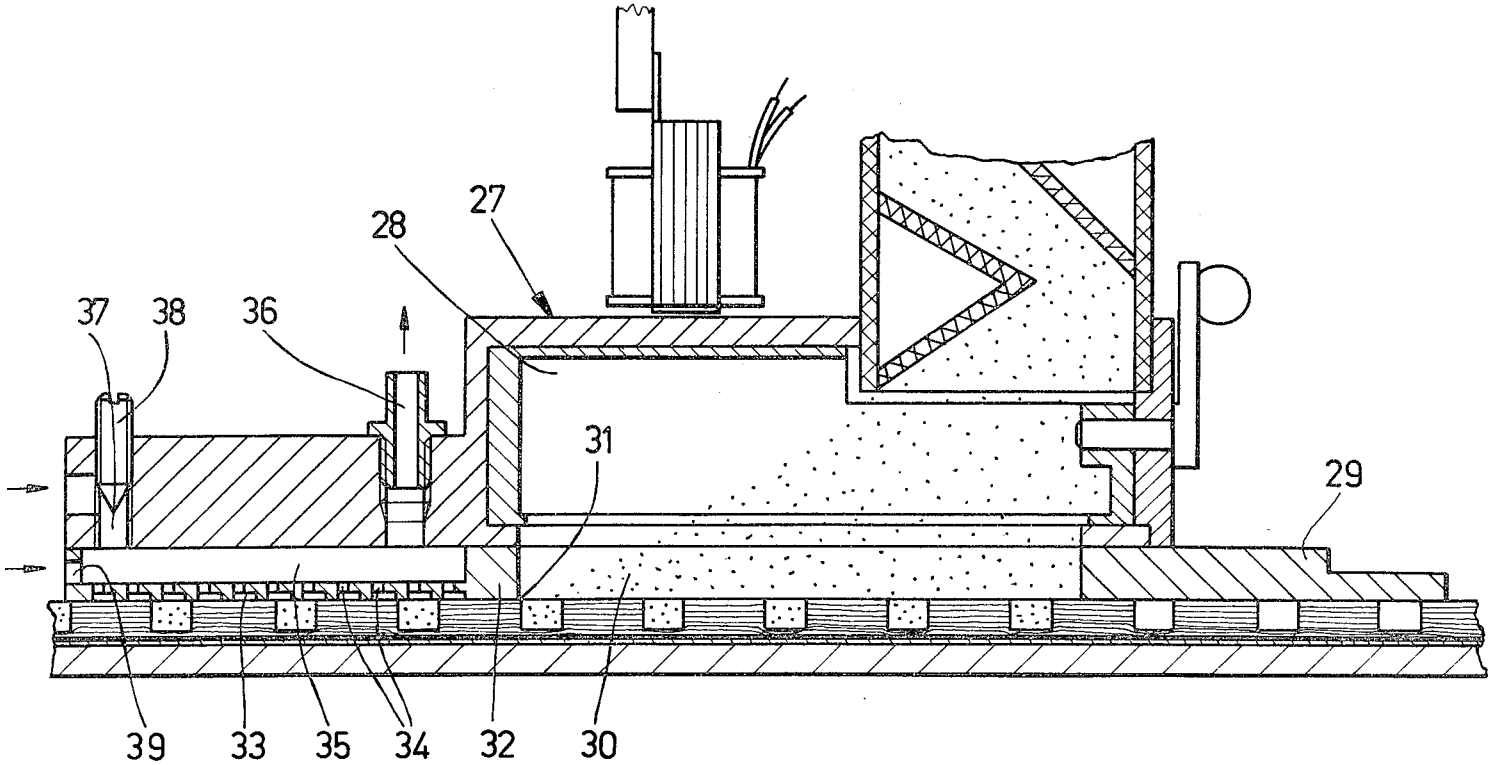
FIG. 20 shows a longitudinal section through the filling station of the system shown in FIG. 1.

After this enveloping of the rod 1' with the strip 17, the rod 1' provided with chambers 14 passes to a filling unit 27, shown in greater detail in FIG. 20, which serves to introduce quasi-fluid filter material, such as activated carbon, into the chambers 14.

The storage box 28 of the filling unit 27 is, as may be seen from FIG. 14 also, provided on its downward outlet end with a sliding element 29 which rests with sealing effect on the side edges of the enveloping strip 17 and on the intermediate free circumferential areas of the rod 1'.

Of course, the filling unit 27 may be provided with an arrangement designed to induce a vacuum in the chambers 14 to be filled, as known from the Swiss Pat. No. 517.448, for instance.

To facilitate the filling of the chambers 14 and the downward feed of the quasi-fluid filter material in the storage box 28 and the outlet slot 30, the filling unit 27 is provided with a vibrator causing the filling unit 27 to vibrate in a vertical plane at 100 Hz, for instance.

Arranged at the end of the outlet slot 30 is an approximately semi-circular stripping edge 31 which limits from above the cross-section of the passing filter element rod 1' and strips off any surplus quasi-fluid filter material. The said stripping edge 31 is arranged on a stripping element 32 which is provided additionally on its underside with sickle-shaped transverse grooves 33 which strip off, and receive, any grains of the quasi-fluid filter material adhering to the filter element rod 1' and the side edges of the enveloping strip 17. To remove any granular or powdery filter material lodged in the transverse grooves 33, these are connected by suction bores 34 to a common chamber 35 which is connected by a suction duct 36 to a negative pressure source and, for regulating the level of the negative pressure, communicates with the ambient atmosphere by means of a bore 37 whereof the flow cross-section is adjustable by a regulating screw 38. To ensure a continual minimal air draught in the chamber 35 for properly removing any filter material lodged therein, the chamber 35 further communicates with the outside atmosphere by means of a non-closable bore 39 provided in its end.

After the filling unit 27, a sealing strip 40, having a width slightly larger than the width of the chamber fill apertures, is fed from above and placed over the chamber fill apertures and bonded to the free surface of the filter element rod 1' and the side edges of the enveloping strip 17 by means of a heatable element 41 which softens the thermoplastic coating of the sealing strip 40. The heatable element 41 is capable of being moved upwards and thus being removed from the sealing strip 40 when the system is shut down.

To achieve an accurate exterior form of the cigarette filter units, the strand, provided with the heated sealing strip 40, passes under a water-cooled cooling unit 42, where the softened thermoplastic coating of the sealing strip 40 sets. Once the filter strand is sealed up, it passes to a cutter 43 which divides it up in such a manner that the length of each section is four or six times the length of a single filter unit required for a cigarette.

Figure 21:
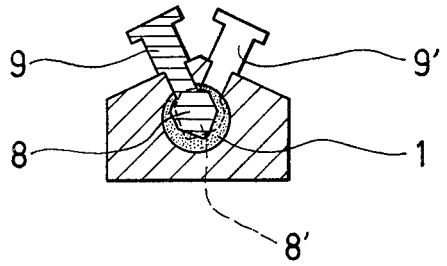
FIG. 21 shows a section analogous to FIG. 5, representing the arrangement of two forming chains in the manufacture of cigarette filters having two chambers.
Figure 22:
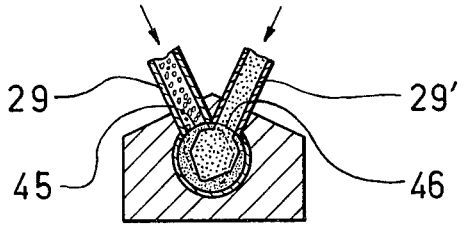
FIG. 22 shows a section analogous to FIG. 21, representing the arrangement of two filling stations arranged side by side in the manufacture of cigarette filters having two chambers filled with different material.
Figure 23:
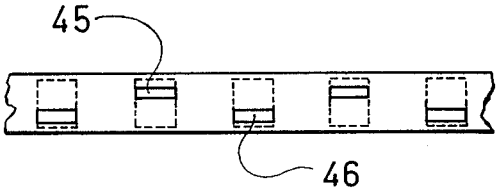
FIG. 23 shows a top view of the filter rod manufactured according to FIG. 21.
Figure 24:
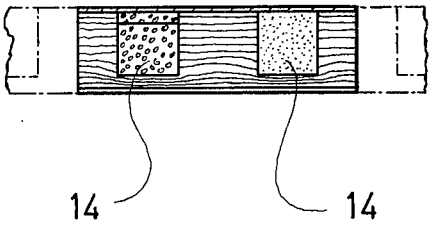
FIG. 24 shows a longitudinal section analogous to FIG. 2 through a cigarette filter having two chambers.

As may be seen from FIGS. 21 and 22, for the manufacture of cigarette filters having two chambers 14,14' (see FIG. 24) it is instead possible to use two conveying elements 9,9' which are arranged in mutually inclined planes extending, in the chamber-forming zone, through the longitudinal axis of the strand, so that the chamber-forming elements of the two conveying elements succeed one another alternately, and thereby to form charmbers 14,14' whereof the chamber fill apertures 22,22' also are arranged alternately on different sides of a plane extending through the longitudinal axis of the strand.

With such a form of the rod 1' having chambers 14,14', it is possible, as may be seen from FIG. 22, to fill successive chambers 14 and 14' with different granulate, by filling the first material through the chamber fill apertures 22 which are arranged on a first strand jacket line 45 and formed by the first conveying belt 9 provided with chamber-forming elements 8, and by filling the second material through the chamber fill apertures 22' which are arranged on a second strand jacket line 46 and formed by the second conveying belt 9' provided with chamber-forming elements 8. This method is advantageous in particular where two filter materials are used and these, in order to optimize their effect, are not to be intermixed.

I claim:

1. Process for the continuous manufacture of form-stable rod-shaped elements from interlocked and interbonded filamentary and/or fibrous filter material, wherein a continuous strand consisting of loose filamentary and/or fibrous filter material is passed to an endless continuously revolving conveying and forming belt, and is enveloped and brought into the desired cross-section by the said belt, and wherein, after achieving the desired strand cross-section, the strand material is interfixed, and the form-stable rod thus formed is divided into rod-shaped portions by a cutting device;

characterized in that the strand, consisting of loose filamentary and/or fibrous filter material, is formed into an extended rod-shaped element of interfixed filamentary and/or fibrous filter material by being brought into engagement with, molded against and transported between;

on the one hand, the conveying and forming belt, which engages the outside of said strand along an extended length thereof to shape thereby at least a longitudinally-extending portion of the exterior of said rod-shaped element; and on the other hand, a linearly moving conveying element which extends along the strand-gripping zone of the conveying and forming belt and which engages the interior of the strand;

said loose filamentary and/or fibrous material being brought into engagement with the conveying belt is substantially tensile free and crimped condition.

2. Process according to claim 1, characterized in that the conveying element used is an endless continuously revolving conveying belt provided on its outside with engaging means which can be brought into engagement with the interior of the strand.

3. Process according to claim 2, characterized in that the strand is brought into engagement with the conveying and forming belt in an at least approximately tension-free condition.

4. Process according to claim 1 or 2, characterized in that, for the manufacture of chambered rod-shaped portions, use is made of a conveying element whereof the engaging means are designed as chamber-forming elements.

5. Process according to claim 4, characterized in that use is made of chamber-forming elements having a form corresponding to the chamber form desired in a final product.

6. Process according to claim 1 characterized in that the strand consisting of loose filamentary and/or fibrous filter material is distributed at least approximately evenly and thus laid around the chamber-forming elements, in a manner that in the chamber-forming zone of the strand, viewed across the entire cross-section, the material density is everywhere at least approximately equal; and that the strand, together with the inserted chamber-forming elements, is next brought to engage the conveying and forming belt, is enveloped by the latter and brought to the final strand cross-section; and that then the strand material is interfixed, and the chamber-forming elements are removed from the now form-stable rod.

7. Process according to claim 1 wherein use is made of a strand of filamentary and/or fibrous filter material whereof the filaments and/or fibres are interbondable by means of a binder which is contained in the strand and is activatable by heat.

8. Process according to claim 7, wherein use is made of a strand of filamentary and/or fibrous filter material whereof the filaments and/or fibres consist of acetate cellulose and are wetted on their surface with a plasticizer.

9. Process according to claims 7 or 8, wherein the strand, prior to its envelopment and compression by the conveying and forming belt, is permeated with a gaseous medium, of a temperature between 110° and 130° C., and, after achieving the desired cross-sectional form of the strand, a cooling gas is passed through the strand material for the purpose of fixing it.

10. Process according to claim 4, characterized in that, for the manufacture of chambered rod-shaped components whereof the chambers are filled with free flowing material, the form-fixed rod, prior to its division into portions, is passed under a filling station, and the chambers are filled with the free flowing material; and that subsequently a sealing strip covering at least the chamber fill apertures is affixed lengthwise of the continuously advancing rod; and that thereafter the rod is divided into the portions desired.

11. Process according to claim 10, wherein, prior to filling the chambers with free flowing material, a masking strip keeping the chamber fill apertures clear is applied lengthwise of the rod.

12. Process according to claim 2 characterized in that the strand consisting of loose filamentary and/or fibrous filter material is fed in loose condition and at an acute angle to the conveying belt which is provided with the chamber-forming elements and which is arranged at least approximately in a straight line and which, in the forming zone, extends at least approximately parallel to the corresponding section of the conveying and forming belt; and that the strand is brought into engagement with the first-mentioned conveying belt.

13. Process according to claim 4, wherein use is made of at least two conveying elements arranged in mutually inclined planes which, in the chamber-forming zone, extend through the longitudinal axis of the strand, so that the chamber-forming elements of the said conveying elements succeed one another alternately in the chamber-forming zone, for the purpose of forming chambers whereof the chamber fill apertures also are arranged alternately on different sides of a plane extending through the longitudinal axis of the strand.

14. Process according to claim 13, wherein different materials are filled into alternate chambers, in that a first material is filled through the chamber fill apertures which are located on a first strand jacket line and which are formed by the first conveying element provided with chamber-forming elements, and that a second material, different from the first, is filled through the chamber fill apertures which are located on a second strand jacket line and which are formed by the second conveying element provided with chamber-forming elements.

15. Process according to claim 4 wherein, for the purpose of preventing any twist of the formed strand about its longitudinal axis after formation of the chambers, guide means which are arranged on a revolving part located in a plane extending through the longitudinal axis of the strand are brought into engagement with the chamber fill apertures.

16. Process according to claim 2 characterized in that the strand consisting of loose filamentary and/or fibrous material is distributed at least approximately evenly and thus laid around the chamber-forming elements, in a manner that in the chamber-forming zone of the strand, viewed across the entire strand cross-section, the material density is everywhere at least approximately equal; and that the strand, together with the inserted chamber-forming elements, is next brought to engage the conveying and forming belt, is enveloped by the latter and brought to the final strand cross-section; and that then the strand material is interfixed, and the chamber-forming elements are removed from the now form-stable rod.

17. Process according to claim 4 characterized in that the strand consisting of loose filamentary and/or fibrous material is distributed at least approximately evenly and thus laid around the chamber-forming elements, in a manner that in the chamber-forming zone of the strand, viewed across the entire strand cross-section, the material density is everywhere at least approximately equal; and that the strand, together with the inserted chamber-forming elements, is next brought to engage the conveying and forming belt, is enveloped by the latter and brought to the final strand cross-section; and that then the strand material is interfixed, and the chamber-forming elements are removed from the now form-stable rod.

18. Process according to claim 5 characterized in that the strand consisting of loose filamentary and/or fibrous material is distributed at least approximately evenly and thus laid around the chamber-forming elements, in a manner that in the chamber-forming zone of the strand, viewed across the entire strand cross-section, the material density is everywhere at least approximately equal; and that the strand, together with the inserted chamber-forming elements, is next brought to engage the conveying and forming belt, is enveloped by the latter and brought to the final strand cross-section; and that then the strand material is interfixed, and the chamber-forming elements are removed from the now form-stable rod.

19. Process according to claim 4 characterized in that the strand consisting of loose filamentary and/or fibrous material is fed in loose condition and at an acute angle to the conveying belt which is provided with the chamber-forming elements and which is arranged at least approximately in a straight line and which, in the forming zone, extends at least approximately parallel to the corresponding section of the conveying and forming belt; and that the strand is brought into engagement with the first-mentioned conveying belt.

20. Process according to claim 10, wherein, for the purpose of preventing any twist of the formed strand about its longitudinal axis after formation of the chambers, guide means which are arranged on a revolving part located in a plane extending through the longitudinal axis of the strand are brought into engagement with the chamber fill apertures.

* * * * *